US006109826A

United States Patent [19]

Mertes

[11] Patent Number: 6,109,826

[45] Date of Patent: Aug. 29, 2000

[54] MELTER AND APPLICATOR FOR APPLYING FILLING MATERIAL TO PAVED SURFACES

[75] Inventor: Anthony J. Mertes, Chanhassen, Minn.

[73] Assignee: Cimline, Inc., Minneapolis, Minn.

[21] Appl. No.: 09/325,053

[22] Filed: Jun. 3, 1999

[51] Int. Cl.[7] ..... F24H 1/18

[52] U.S. Cl. ..... 404/95; 404/107; 404/111; 392/472; 392/478

[58] Field of Search ..... 392/471, 472, 392/478; 404/92, 95, 107, 111

[56] References Cited

U.S. PATENT DOCUMENTS

| | | | |
|---|---|---|---|
| 2,970,351 | 2/1961 | Rice . | |
| 3,090,675 | 5/1963 | Ruff et al. . | |
| 3,581,782 | 6/1971 | Onufer | 141/59 |
| 3,675,400 | 7/1972 | Kubsch | 55/385 |
| 3,804,079 | 4/1974 | Schrader | 126/343.5 A |
| 3,844,901 | 10/1974 | Roe et al. | 202/263 |

(List continued on next page.)

| | | | |
|---|---|---|---|
| 5,443,325 | 8/1995 | Simonelli et al. | 404/75 |
| 5,591,244 | 1/1997 | Vross et al. | 55/356 |
| 5,832,178 | 11/1998 | Schave | 392/472 |
| 5,873,919 | 2/1999 | Vross et al. | 55/315.1 |
| 5,974,227 | 10/1999 | Schave | 392/478 |
| 6,049,658 | 4/2000 | Schave et al. | 392/472 |

OTHER PUBLICATIONS

Brochure: Cimceal Melter—Applicator, Model 125—Trailer Mounted; Specifications & Features, by Cimline Construction Materials, Inc., 5C 1082 PR.

Brochure: Climline Model 60 Trailer–Mounted Joint Seal Melter–Applicator; specifications; by Cimline.

Brochure: Cimline Melter/Applicators Models 100 and 200; specifications; by Cimline.

Brochure: Cimline Models 50, 100 and 200 Melter–Applicators; specifications; by Cimline.

Brochure: Cimline Model 210 Diesel Melter–Applicator; specifications; by Cimline.

Brochure: Cimline Pavement Maintenance Products, 105 Melter Applicator; specifications; by Cimline.

Brochure: Crafco Super Shot Melters, E–Z Pour Melters, list of features; by Crafco Inc.

Brochure: Crafco Inc. Equipment; Specifications for E–Z Pour 50P Melter; by Crafco Inc.

Brochure: Application Equipment: E–Z 50, E–Z 100, E–Z 200, E–Z 200D, E–Z 50P, Sealant, Pavement Cutter, E–Z Pour 50 Melter, E–Z Pour 50P Melter, E–Z Pour 100 Melter, E–Z Pour 200 Melter, E–Z Pour 200D Melter, Model 200 Pavement Cutter; by Crafco Inc.

Brochure: Crafco Model BC 220 Sealer; specifications; by Crafco Inc., BC 220.

Brochure: Crafco Model BC 220–4 Sealer; specifications; by Crafco Inc., BC 220–4.

(List continued on next page.)

*Primary Examiner*—James A. Lisehora
*Attorney, Agent, or Firm*—Alan Kamrath; Donnelly LLP

[57] ABSTRACT

A melter and applicator (10) is shown for applying liquefied paving material to damaged pavement. The applicator (10) reduces the problems which occur due to the unintentional solidification of the paving material within the hose (74) of either the heated or unheated type. A cabinet (44) is provided which is selectively able to maintain the temperature of the unheated hose (74) during periods of non-use. In addition, a wand access port (100) is provided which allows either type of hose (74) to be run continuously, directing material back to a supply bin (26). In addition, a chimney (40) is provided which vents the by-products of combustion generated while melting the paving material. This chimney, (40) is fluidly coupled to the bin (26) which contains the paving material so that noxious fumes produced during the melting are drawn off.

20 Claims, 2 Drawing Sheets

U.S. PATENT DOCUMENTS

| | | | |
|---|---|---|---|
| 3,880,143 | 4/1975 | Hart et al. | 126/343.5 A |
| 3,955,236 | 5/1976 | Mekelburg | 15/314 |
| 3,988,421 | 10/1976 | Rinaldi | 423/210 |
| 4,087,333 | 5/1978 | Naevestad | 202/227 |
| 4,092,095 | 5/1978 | Straitz, III | 431/114 |
| 4,450,900 | 5/1984 | Nathan | 165/42 |
| 4,512,245 | 4/1985 | Goldman | 98/115.4 |
| 4,563,943 | 1/1986 | Bertelsen | 98/115.1 |
| 4,692,028 | 9/1987 | Schave | 366/22 |
| 4,770,088 | 9/1988 | Kistner | 98/115.2 |
| 4,804,392 | 2/1989 | Spengler | 55/356 |
| 4,859,073 | 8/1989 | Howseman, Jr. et al. | 366/195 |
| 4,865,628 | 9/1989 | Iwanczyk | 55/74 |
| 5,004,483 | 4/1991 | Eller et al. | 55/20 |
| 5,036,754 | 8/1991 | Simms et al. | 98/115.4 |
| 5,064,451 | 11/1991 | Phillips | 55/74 |
| 5,069,691 | 12/1991 | Travis et al. | 55/126 |
| 5,073,259 | 12/1991 | Solimar | 210/232 |
| 5,160,515 | 11/1992 | Nelson et al. | 55/267 |
| 5,183,646 | 2/1993 | Anderson et al. | 423/210 |
| 5,191,909 | 3/1993 | Nadeau et al. | 135/93 |
| 5,223,005 | 6/1993 | Avondoglio | 55/96 |
| 5,281,246 | 1/1994 | Ray et al. | 55/302 |

OTHER PUBLICATIONS

Brochure: Aeroil Featuring Unique Heated Hose Concept: Equipment Selection and Road Maintenance Applications Chart; specifications; by Aeroil Products Co., Inc.

Brochure: BMA–100 Melter/Applicator with Oil Heated Hose System; specifications; by Berry Corporation.

Brochure: BMA–200 Joint/Crack Sealer; specifications; by Berry Corporation.

Brochure: Oil Jacketed Crack Sealer; specifications; by Cleasby Manufacturing Company Inc.

Brochure: Extrudamat Crack Sealing Machine; Models ECS 1000 & ECS 400; specifications; by Bergkamp Incorporated.

Brochure: Compare the Competitive Advantages of W.H. Manufacturing's "Seal King" Crack–Sealers; specifications; by W.H. Manufacturing.

Brochure: Bartseal 24 "Hot Rubber" Melting Kettle; specifications; by Bid–Well Corporation.

Brochure: Rubber Master A Protest Against Wasted Time; description/specifications for The Hot Pot, The Versatile Mini 100, Model 360; by Rubber Master.

Brochure: Bearcat Model BK–350D Diesel Kracker; by BearCat Mfg.

Brochure: Stepp's Oil Jacketed Kettles, models and features; by Stepp Mfg. Co., Inc.

Brochure: Reeves Afterburner Jun. 1996.

Roofer Magazine, Feb. 1997, pp. 48, 49, 54, 56 & 57.

MELTER AND APPLICATOR FOR APPLYING FILLING MATERIAL TO PAVED SURFACES

BACKGROUND

The present invention relates generally to a melter and applicator for applying filling or sealing material, such as liquefied asphalt, to damaged paved surfaces. More particularly, the present invention relates to a melter and applicator which is able to interchangeably utilize either heated or standard hoses to optimally deliver the filling material.

Paved surfaces are constantly subjected to various thermal and pressure induced stresses. As a result, these surfaces routinely fracture, creating cracking that will propagate if left unchecked, as well as more substantial holes which similarly expand over time. This type of pavement damage reduces the useable lifetime of the surface and also poses a substantial risk to those who utilize it as a means of travel.

Simply tearing up the damaged surface and replacing it in its entirety is far too costly and time consuming to be done on a regular basis. As such, it has become standard practice to repair damaged pavement before it reaches a point where replacement is required. To repair damaged pavement, a section is cut from the surface, which creates a uniform channel. The channel is cut to coincide with the propagation of the cracking and serves to ease the removal of the damaged pavement and any debris which may have accumulated. Once the channel is formed, heated paving material (such as "rubberized" asphalt) that has been liquefied is applied and fills the channel. As the paving material cools and solidifies, it bonds with the surrounding pavement thus sealing and filling the channel. The asphalt provides a flexible joint which effectively seals the crack, preventing water from seeping in as the pavement expands and contracts.

Due to the nature of the material being utilized, specialized equipment is required to store, prepare and apply the liquefied pavement. This equipment must be portable so as to allow it to be taken to the damaged area. As such, it is usually mounted on a frame which is pulled behind a vehicle. The frame includes all of the components necessary to perform the repairs. In general, solidified paving material, such as bricks of asphalt, are placed into a relatively large bin. The bin is then heated to a temperature sufficient to liquefy the material. The bin is constantly agitated to insure uniformity and to prevent the material from cooling and hardening.

The liquefied material is then pumped out of the bin, through a hose, and out of a nozzle where it is controllably directed into the channel cut into the pavement. Handles are placed at or near the nozzle to allow the operator to control the hose, as the temperature of the material would make direct contact hazardous.

Significant problems occur when the liquefied paving material is left in any portion of the system and allowed to cool. Specifically, the various connecting pipes and hoses will become plugged and either seriously impede or totally prevent any subsequent fluid flow. Material left within the pump will also solidify, rendering the pump inoperable. To use the pump again, it must be heated for a relatively long period of time, thereby liquefying the pavement material, and allowing fluid flow through the pump. As such, it becomes necessary for the operator to perform this step well in advance of when the applicator is expected to be used. Therefore, in normal operation, the pump will only be allowed to solidify when the applicator is no longer needed in a given day. The following day, the applicator is then heated prior to its initial use to free the pump and thereby bring the applicator into a working condition.

To avoid such problems, previous melter/applicators have sought to prevent the material from cooling at any point within the system. To accomplish this, the various components are kept at or above a temperature sufficient to maintain the paving material in a liquid state. There have been two separate and distinct methods for accomplishing this. In the first method, a cabinet is provided that is adjacent to the heating chamber and/or the heated bin. The pump is located within this cabinet and is maintained at the proper temperature through the heat transfer that occurs due to the proximity of the cabinet to the heating chamber and/or heated bin. In addition, these melter/applicators always employ a recirculating pump. That is, the pump is either continuously or systematically actuated to draw the liquefied material from the bin, through the pump and then deliver it at least back to the bin. This serves to bring heated material to the pump, which acts to heat the pump and also prevents any of the liquefied material from settling within the pump. When the operator desires to use the applicator, this recirculation is minimized thus directing a majority of the fluid flow through the hose.

The hose itself is a primary area of concern. If left alone, the liquefied material would solidify in a relatively short period of time, either seriously occluding or totally blocking subsequent fluid flow. Generally, when in use this problem is minimized in that heated liquid is constantly flowing through the hose. This serves to both heat the hose and to remove any material which may have congealed. During periods of sporadic use or during periods of non-use, the paving material will have a tendency to solidify. To prevent this from occurring, sufficient room is provided within the cabinet to allow the hose to be stored. While in this heated environment, the paving material is kept at or raised to a temperature above its congealing temperature.

While the heated cabinet can effectively prevent material solidification when properly used, it may be under utilized. That is, the operator may have a tendency to leave the hose out at times when it should have been placed in the heated cabinet. For example, the operator may have underestimated the time between consecutive applications. Due to the bulkiness of the hose and the hassle associated with coiling it into the cabinet, the operator may err on the side of leaving it out, if time is a consideration. Therefore, applicators utilizing a heated cabinet have also provided a wand access port. This allows the operator to place the wand of the hose into the wand access port and to allow the liquefied paving material to flow through the hose and back into the bin. By so doing, the paving material is prevented from solidifying within the hose and the operator is less burdened.

In the second method, the heated cabinet and recirculating pump have been eliminated altogether. Instead, a pump is actually placed within the heated bin and is therefore always maintained at the proper temperature while the applicator is in use. The pump does not continuously recirculate material. However, when material does not flow through the hose during extended periods of non-use a heated hose must be utilized, such as with the mix applicator shown in U.S. Pat. No. 5,832,178, issued to Schave on Nov. 3, 1998. Hoses can be heated by generating an electrical current through a wire (or wires) that is coiled about the outer circumference of the hose. The hose is heated right up to the coupling of the hose to the pump outlet, thus leaving no section of the pump or its couplings unheated. The heated hose can be left unused for relatively long periods of time, as the heating element coiled about the hose will prevent the pavement material from solidifying. Traditionally, a relatively long wand (several feet long) is coupled to the end of the hose. A valve is usually located at this connection, allowing the operator to control the flow of liquid. Since the wand is so long, it must be heated separately. As such, a second electrical heater is wrapped around the wand section, thus preventing material solidification from occurring there.

Substantial problems occur when the pump fails, as it is located within the bin. That is, when a failure occurs, the liquefied material in the bin must be dealt with while simultaneously attempting to service the pump. If the material solidifies, it must be melted in order to gain access to the pump. When the material is liquefied it must then be removed to allow access to the pump, thus seriously complicating an otherwise simple task.

While effective at preventing material solidification, the electrically heated hoses are very expensive (in excess of $2000.00 per hose). Generally, heated hoses will cost 3–5 times more than standard, unheated hoses. A failure of a heated hose results in the applicator being generally out of service until a new heated hose is purchased and/or delivered, as there is no practical way to prevent stagnant material from solidifying in the hose. Because of their expense, it is not feasible to have spare heated hoses on hand, as this would require a substantial investment, which may or may not ever be utilized on any particular day. For example, a particular paving repair company will likely have many applicators which are simultaneously in use at various disparate, separate job sites. It would simply be too costly to have spare electrically heated hoses brought to every one of these job sites. The company may have extra hoses, maintained at a central location. However, it is not practical to have enough to resupply all of the applicators. Furthermore, it takes time, and hence delays use, to retrieve the hose from such a central supply. Such delays of course result in loss of revenues.

The hoses for melter/applicators are made as durable as possible while still allowing sufficient flexibility to perform its repair function. However, the hose for a melter/applicator is exposed to harsh conditions. It is continuously dragged over rough pavement, repeatedly heated and cooled, and forced to carry rather abrasive and chemically reactive material. Therefore, the useful lifetime of such a hose is limited. If the hose itself does not rupture, the heating element of a heated hose can be damaged thus eliminating the system's only means of preventing solidification of the paving material within the hose.

Because of the heating element, heated hoses are less flexible, generally much more fragile, and much more cumbersome to work with than standard hoses. As an example, the presence of the heating element makes the heated hose less maneuverable in use, has a greater minimum bend radius which may prevent coiling inside a heated cabinet without potentially damaging the heated hose and which contributes to faster failure of the hose from fatigue as the result of use. As such, many operators choose not to use heated hoses. During the warmer months, when temperatures reach 60° F. (16° C.) or higher, material can be left inside the hose for 2–3 minute periods without solidification occurring. This is usually sufficient time to allow movement of the hose between applications without returning the wand of the hose to the access port, thus making the less cumbersome, standard hose more appealing to the operator. However, when temperatures fall below 40° F. (4° C.), gelling or solidification occurs rapidly over the length of the unheated hose. The heated hoses readily handle such temperatures. Thus, the operator is more inclined to use heated hoses during those periods, even though less maneuverable and more cumbersome than conventional hoses, because it is not necessary to return the wand of the hose to the access port, making the repair process easier and faster under cool temperature conditions with a heated hose. In order for the operator to have such a choice prior to the present invention, separate incompatible systems must be provided. Companies that do this incur substantial costs; those that do not severely limit their operator's equipment choices.

Therefore, there exists a need to provide a melter/applicator which has the benefits of utilizing a heated hose when operating conditions warrant its use, while also accommodating the use of non-heated hoses when operating conditions permit avoiding the shortcomings of the heated hoses.

SUMMARY

The present invention is a melter/applicator that supports the use of both heated and non-heated hoses to apply liquefied paving materials to damaged surfaces.

The applicator of the present invention includes a frame which is towable behind a vehicle. Supported on the frame are a bin and a heating chamber. Solid paving materials, such as asphalt, are placed into the bin and are heated by the heating chamber. The heating chamber generates sufficient heat to liquefy the paving materials. An internal combustion engine is mounted on the frame and provides power to operate various components such as a recirculating pump and an agitator that is located within the bin to continuously mix the paving materials. The motor is coupled to an electric generator and a hydraulic pump to provide the necessary electric current and hydraulic force. The recirculating pump is located within a heatable cabinet that is adjacent to the heating chamber so that the cabinet may be maintained at a temperature sufficient to maintain the liquid state of the paving materials. The pump recirculates liquid paving material by drawing it from the bin, passing it through the pump, and returning it to the bin.

A hose is coupled to an outlet of the pump. The hose can either be of the heated or unheated type. When utilizing a heated hose, an optional extension is attached to the outlet of the pump so that the coupling of the heated hose to the pump outlet occurs outside of the heated cabinet. When utilizing an unheated hose, this coupling occurs within the heated cabinet. With the applicator of the present invention, the operator can readily choose the most convenient and easy to work with hose, based on the task at hand as well as the current temperature. This will provide the desired level of flexibility without causing excessive equipment expenses.

When a valve attached to one end of the hose is opened, liquefied paving material is drawn by the pump, out of the bin and passed through the hose in a controlled fashion. When not in use, the valve is closed. If a heated hose is used, that hose may be left unattended as the heating element will maintain any paving material within the hose in a liquefied state. When the standard hose is attached, but not being used, it may be coiled and stored within the heated cabinet to maintain it at a sufficient temperature to maintain the paving material in a liquid state. In addition, both types of hoses must be cleared prior to their initial use on any given day. As such, the electrically heated hose would be self heated, or the standard hose would be left in the cabinet while the cabinet was heated, to liquefy the paving material remaining in the hose from the last use.

A wand access port is coupled with the bin and has an openable cover. To further decrease the likelihood that paving material may solidify in either type of hose, the wand of the hose is placed in the wand access port and the valve of the hose is opened. As such, material is continuously pumped through the hose, but is immediately returned to the bin.

A chimney is provided and is coupled to the heating chamber. The chimney vents the gases generated during the burning of a fuel source for heating. During the course of heating, paving materials in the bin generate a substantial amount of noxious gas and smoke. The chimney is connected to the bin which contains the heated paving materials. The chimney is coupled to the bin at a point which is higher than the level of the liquid in the bin. As such, as the fumes from combustion are vented up through the chimney, the draw created acts to remove the gas and smoke present in the bin. This is advantageous when an operator wishes to visually verify the level and status of the liquefied paving material. When the lid to the bin is opened, the operator will have a clear and safe view of the level of the heated paving materials present in the bin.

The present invention will become clearer in light of an illustrative embodiment of this invention described in connection with the drawings.

BRIEF DESCRIPTION OF THE DRAWINGS

The illustrative embodiment may best be described by reference to the accompanying drawings where.

Figure 1:
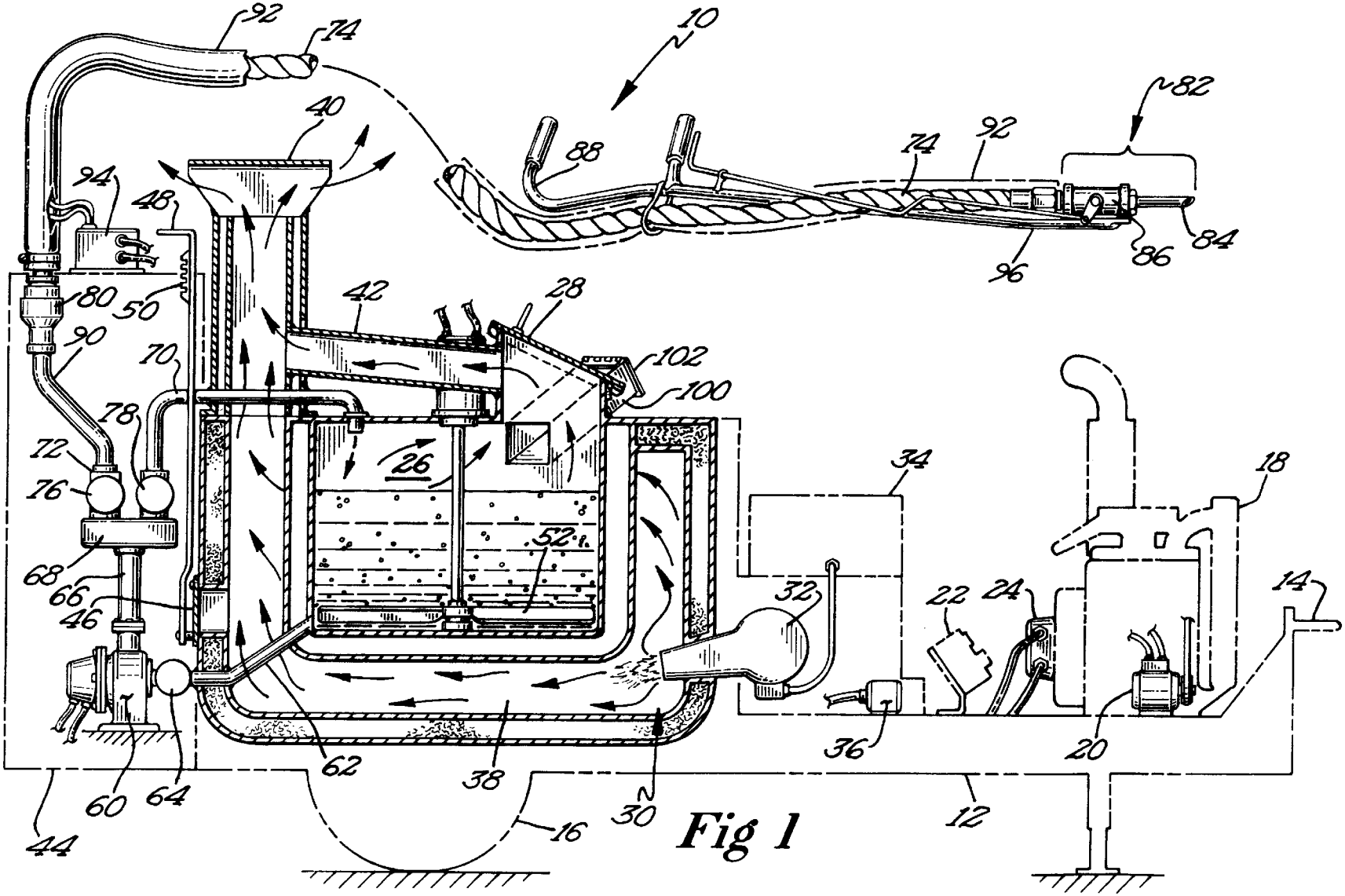
FIG. 1 is a side, partially sectional view schematically showing a melter and applicator for applying liquefied paving material, with portions shown in phantom.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top," "bottom," "first," "second," "inside," "outside," and similar terms are used herein, it should be understood that these terms have reference only to the structure shown in the drawings as it would appear to a person viewing the drawings and are utilized only to facilitate describing the illustrative embodiment.

DESCRIPTION

A melter and applicator for applying filling or sealing material, such as liquefied asphalt, according to the preferred teachings of the present invention is shown in the drawings and generally designated 10. In the most preferred form, applicator 10 is transported on a frame 12 that is towable behind a vehicle. As such, the frame 12 has a standard trailer hitch 14 along with wheels 16, thus forming a trailer. The various components required to repair damaged pavement are securely mounted onto the frame 12 so that it may readily be towed to any paved area requiring repair.

An internal combustion engine 18 is mounted on the frame and provides the motive force necessary to operate many of the functions of applicator 10. The engine 18 includes a generator 20 for generating electrical current. For smaller or larger applicators 10, the engine 18 could be eliminated and the components could simply be coupled to the towing vehicle's electrical system. A hydraulic pump 24 is also driven by engine 18. A control box 22 is coupled with the engine 18 and serves to control the engine 18 and the hydraulic pump 24.

A bin 26 is provided, having an access cover 28. The bin 26 is a relatively large kettle made of a suitably strong material which will withstand the repeated heating of various volatile materials as well as supporting the weight of a large volume of these materials. Surrounding the bin 26, is a heating system 30. The heating system 30 includes one or more burners 32 which are supplied with a fuel, such as LP (liquid propane) gas. A fuel supply container 34 is provided on the frame 12 to deliver fuel to the burner 32. The burner 32 is directed into a heating chamber 38. The heating chamber 38 essentially surrounds the bin 26 on all but its upper surface. Heat directed into the heating chamber 38 effectively and efficiently heats the bin 26 and its contents. A burner control 36 is provided to control the operation of the burner 32.

A chimney 40 forms part of the heating system 30 and is coupled to the heating chamber 38. The chimney 40 vents the byproducts of the combustion of the burner 32 out of the heating chamber 38 in a controlled fashion. In addition and in the most preferred form, the chimney 40 is fluidly connected to the bin 26 via chimney tube 42. As the chimney 40 vents fumes from the combustion, a draw is created which siphons off any gaseous material which may be trapped in an upper portion of the bin 26, thus directing it from the bin 26, through the chimney tube 42 and out through the chimney 40. Due to the elevated temperature of the fumes venting through the chimney 40, the gaseous material siphoned from the bin 26 is burned or otherwise consumed in the chimney 40 so that the exhaust from the chimney 40 is relatively clean and odorless. However, a separate burner unit (not shown) may be incorporated into the chimney tube 42. This burner unit would burn the byproducts produced in the bin 26, thus purifying, to some extent, the emissions from the bin 26.

Figure 2:
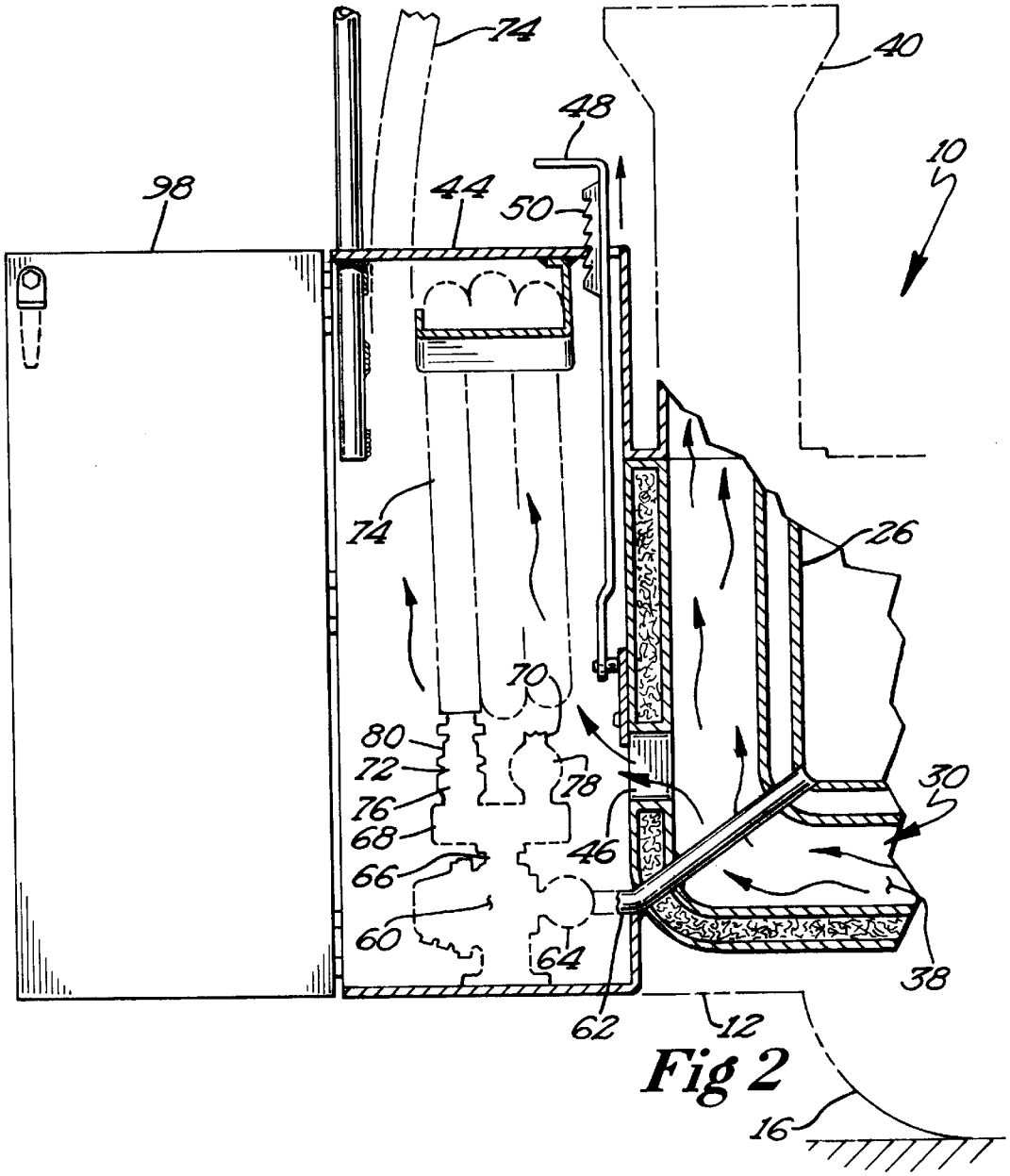
FIG. 2 is a partial side, partially sectional view schematically showing the heatable cabinet of the melter and applicator, along with a hose, with the access door of the heatable cabinet shown in an open position.

In the preferred form shown, the applicator 10 includes a cabinet 44 adjacent to the heating system 30. The cabinet 44 is a relatively large, empty chamber which is also selectively heated by the burner 32 within the heating chamber 38. When the cabinet 44 is to be heated, a vent 46 is opened which couples a portion of the heating chamber 38 to the cabinet 44. Once the vent 46 is opened, heat flows from the burner 32, through the heating chamber 38 and into the cabinet 44. While any appropriate type of control may be employed, FIG. 1 shows a control arm 48 connected to the vent 46. By controlling the amount that vent 46 is opened, the operator can effectively control the amount of heat that is allowed to enter cabinet 44. As the control arm 48 is raised, it pulls vent 46 further open. As shown in FIG. 1, the vent 46 is in a closed position. No significant amount of heat is allowed to enter the cabinet 44. FIG. 2 illustrates vent 46 in its open most position. That is, control arm 48 has been raised, pulling vent 46 open. The vent 46 is adjustable by latching control arm 48 in various positions by a cooperation of teeth 50 with the upper surface of cabinet 44.

In use, access cover 28 is opened and solidified paving materials, such as asphalt bricks, are placed within the bin 26. The burner 32 is ignited and heats the bin 26 and its contents to a temperature sufficient to liquefy the paving material. For asphalt, this will usually require a temperature range between about 250°–500° F. (120°–240° C.). Concurrently, an agitator 52 located within the bin 26 constantly mixes the heated paving materials. This is done to assure an even distribution of the material and to prevent pockets of solidification from forming inside of the bin 26. The agitator 52 is coupled to a hydraulic motor which is in turn coupled to the hydraulic pump 24. As the paving material is utilized and withdrawn from bin 26, more bricks are added to the bin 26 so that a sufficient supply is maintained.

During the course of heating the paving materials, various noxious fumes and smoke are created. The access cover 28 to the bin 26 is generally kept closed to maintain the efficiency of the heating process. Therefore, the fumes and smoke created are trapped within the bin 26. In order to maintain a sufficient supply of paving material, an operator must periodically inspect the bin 26 and visually determine the level of the supply as well as the condition of the material. Because the mixture will at times contain a large percentage of solid as well as liquefied material, automated detection means are currently generally not available. To decrease the health hazard imposed on the operator and to facilitate the required visual inspections, the applicator 10 in its most preferred form has the chimney 40 of the heating chamber 38 connected with bin 26 via chimney tube 42 at a point above the level of the paving mixture. As discussed above, the fumes and smoke will be drawn out of the bin 26 and vented through the chimney 40. Without the use of chimney tube 42, cover 28 would have to be opened for three to four minutes in order to allow the fumes and smoke sufficient time to clear. Leaving the cover 28 open for this long also permits a large amount of heat to escape, thus seriously reducing the efficiency of the heating system 30. This problem is exacerbated by the fact that such inspections must occur fairly frequently. Therefore, chimney tube 42 serves to reduce the amount of time access cover 28 must remain open. This increases the efficiency of the heating system 30 and saves the operator a significant amount of time.

In the preferred form shown, a recirculating pump 60 is located within the cabinet 44. An inflow pipe 62 is coupled between the pump 60 and the bin 26. The inflow pipe 62 is positioned at or near the bottom of the bin 26 to enable the pressure generated by the volume of the paving material to assist the pump 60 in drawing liquefied paving material through the inflow pipe 62. A first shut off valve 64 is located between the inflow pipe 62 and the pump 60. Coupled to the outlet 66 of the pump 60 is manifold 68 which joins an outflow pipe 70 and a supply line 72. The outflow pipe 70 is a return line that leads back to the bin 26 and the supply line 72 is coupleable to a hose 74. A second shut off valve 76 couples the manifold 68 to the supply line 72. A differential valve 78 couples the manifold 68 to the outflow pipe 70. The differential valve 78 allows the operator to set the flow rate of material returning to the bin 26. When the supply line 72 is occluded (either because shut off valve 76 is closed or the valve 86 of an attached hose 74 is closed), the pump 60 is in a recirculation mode. That is, the pump 60 draws liquefied paving material out of the bin 26 through the inflow pipe 62 and returns it to the bin 26 through outflow pipe 70. The recirculation is generally continuous but could be intermittent. The recurrent flow of the liquefied paving material through the pump 60 prevents any of the material from settling long enough to cool and solidify during normal operation.

In the preferred form, a connector 80 which provides a releasable, rotatable connection is provided at one end of the hose 74. At the opposite end, the hose 74 will generally have a wand 82 that terminates at a replaceable nozzle 84. Wand 82 also includes an adjustable valve 86 that allows the operator to control the flow of the liquefied paving material. A handle 88 is connected to the hose 74 and lets an operator control the wand 82 without having to directly contact the hose 74 itself. Since pump 60 is of the recirculating type in the most preferred form, fluid is continuously moved through differential valve 78, and selectively moved through shut off valve 76, the hose 74, and valve 86 when each is set to an open condition. The differential valve 78 is adjusted so that adequate pressure will be supplied to the hose 74, when desired.

FIG. 1 illustrates applicator 10 according to the preferred teachings of the present invention being used with a heated hose 74. An extension 90 has been added to the supply line 72 so that the connector 80 between the hose 74 and the extension 90 occurs proximate an outer surface of the cabinet 44. Since the heated hose 74 need not be placed into the cabinet 44, it is logical to have the connection occur at this point so that a maximum length of hose 74 is available to perform the desired pavement repair function.

The heated hose 74 is heated by a heating element which surrounds the hose 74 and a heating unit which powers and controls the heating element. The heated hose 74 is heated by a sheath 92 which surrounds the hose 74. As an example, a heating element may be woven into the sheath 92, and as it is energized, it generates thermal energy which is transferred through the sheath 92 to the hose 74. In one preferred embodiment, as shown in FIG. 1, the heating element is an electrical coil and the heating unit is generator 20 with the heating element of the sheath 92 being coupled to a junction box 94 that receives electric current from generator 20. It should be appreciated that any appropriate combination of a heating element and heating unit, including but not limited to, electric coils, heated fluid or hydraulic coils, heated air coils, or any type of convective or conductive heating element may be utilized to heat the hose 74 according to the teachings of the present invention.

The sheath 92 extends all the way to the connector 80 between the hose 74 and the supply line 72 and the extension 90. Traditionally, at the opposite end, the sheath 92 ends and a relatively long wand begins. The handle 88 is usually located at the point where the handle 88 meets the sheath, so the wand is several feet long and requires separate heating. In the present invention, the wand 82 is significantly shorter. The present wand 82 includes the valve 86 with a short, replaceable nozzle 84. The nozzle 84 will wear as it is dragged along the pavement, over time. Wand 82 is coupled directly to an extension bar 96 which runs along a segment of the hose 74 and is joined with handle 88. With this configuration, sheath 92 is able to run the entire length of the hose 74, right up to the valve 86. In other words, only the relatively short wand 82 remains unheated. However, because wand 82 is so close to the sheath 92 and the otherwise heated paving materials, conductive heat transfer will minimize any potential solidification problems.

In the most preferred form, applicator 10 supports the use of both electrically heated and standard non-heated hoses 74. FIG. 2 shows a standard hose 74 that is coupled to the supply line 72 by the connector 80. As shown, the unheated hose 74 can be coiled within the cabinet 44 during a period of non-use. Access door 98 is shown in an open position giving the operator access to the interior of the cabinet 44. To prevent any liquefied paving material that remains in the hose 74 from solidifying, vent 46 is opened, allowing the cabinet 44 to be heated. Because the entirety of the hose 74 should be heated, the coupling between the hose 74 and the supply line 72 occurs within the confines of the cabinet 44 as shown in FIG. 2. When the hose 74 is to be used, it is directed out through an opening in the top of the cabinet 44.

When either type of hose 74 is being employed but not utilized, the wand 82 can be placed into the wand access port 100. The wand access port 100 is essentially a small portal into the bin 26. Cover 102 prevents heat loss when the wand access port 100 is not being used. Once the cover 102 is opened, wand 82 is inserted into the wand access port 100. The control valve 86 is opened allowing free flow of the liquefied paving material through the hose 74. The liquefied paving material simply returns immediately to the bin 26. The constant flow of heated material through the hose 74 serves to heat the hose 74, prevent the accumulation of material which may congeal, and remove any material which may have already solidified. This technique is applicable to either the heated or unheated hoses 74. This is also useful to liquefy solidified materials in the wand 82. By placing the wand 82 in the wand access port 100, the heat of the bin 26 will serve to heat the wand 82 and any material contained therein. Furthermore, if only a small amount of material has solidified, opening valve 86 may cause that material to be forcibly ejected.

In use of applicator 10 according to the teachings of the present invention, the paving material is heated in the bin 26. Once the material has reached a sufficient temperature, the pump 60 will begin to recirculate the liquefied paving material. While this is occurring, the applicator 10 may be taken to a site where repairs are to be made. Assuming a heated hose 74 is utilized, it is coupled to the generator 20 of the engine 18 so that electrical current is supplied to the heating element surrounding the hose 74. Any material which may have been left in the hose from a previous application is subsequently liquefied. The hose 74 may be attached to a pivotable support arm, partially shown in FIG. 2, which makes it easier to manipulate the hose 74 and also keeps a majority of the hose 74 both off the ground and out of the way.

At some previous point, the damaged pavement had been cut to form a channel. The operator then guides the nozzle 84 along this channel with the valve 86 in an open position. Valve 86 will only be opened far enough to allow a sufficient amount of material to flow into the channel. Liquefied paving material flows through the hose 74 and fills the channel. During periods of non use (i.e., between applications or while moving to a new location), the operator may simply leave the hose unattended as the heating coils surrounding the hose will prevent solidification of the paving material. Alternatively, the operator may place the wand 82 into the wand access port 100 and subsequently open the control valve 86 allowing the heated paving material to freely flow through the hose 74. Despite the fact that the hose 74 is heated, the operator may choose to do this for several reasons. First, in the event the heating system fails while the hose 74 is unattended, problems are avoided. Second, the electrical heating system could be shut off during the time, reducing the load on the engine 18. Third, this allows a larger volume of recirculation for the pump 60 and the supply line 72 and also aids in the agitation of the bin 26. Fourth, it maintains the wand 82 at the proper temperature and prevents material from solidifying in nozzle 84. Alternatively, wand 82 could simply be placed into wand access port 100, without opening valve 86. This would simply allow the wand 82 to be heated without engaging in any fluid flow.

During subsequent applications, the heated hose 74 is used in the same manner as described above. Should any type of problem develop with the heated hose 74, such as a rupture or a failure of the heating system, and another heated hose is unavailable, the heated hose 74 is removed and a standard hose 74 is coupled to the supply line 72. The extension 90 of the supply line 72 may be removed so that this coupling takes place adjacent the pump 60. Once so connected, the channels cut into the damaged pavement are filled in the same manner described above. During periods of non use, the operator has two options. For shorter periods, it is easiest to insert the wand 82 into the wand access port 100 and allow free flow of the heated paving material. For longer periods of time, the hose 74 is coiled and stored within the cabinet 44 (as shown in phantom in FIG. 2). The vent 46 is opened allowing a transfer of heat from the heating system 30 into the cabinet 4 sufficient to keep the liquefied paving material from solidifying. At this point, the operator can order a new heated hose (if desired) but is able to utilize applicator 10 with the standard hose 74 or with a hose 74 in which the heating component has failed but which has not ruptured until it eventually arrives.

The applicator 10 according to the preferred teachings of the present invention allows a pavement repair crew to complete their task, even when their electrically heated hose 74 fails. This represents a tremendous savings in both time and money. Previously, such a failure would effectively preclude the continued use of the liquefied pavement applicator until a new heated hose could be ordered and delivered. The cost of such a hose prevented the repair crews from keeping extra heated hoses on hand. Unheated hoses could not simply be substituted on these systems, because there was no practical way to prevent the solidification of the paving material within the hose, during periods of non-use. The nature of the repair work dictates that there will inevitably be such periods of non-use, and therefore, such a substitution was not possible. With the advent of the present invention, unheated hoses 74 can now be used with a system that supports electrically heated hoses. By providing a selectively heated cabinet 44, the unheated hose 74 can be substituted and properly maintained. When the electrically heated hose is utilized, the cabinet 44 may be unheated, thus increasing the efficiency of the bin heating process. The particular cabinet arrangement also allows the operator to maximize the length of the hose 74 provided. Thus, applicator 10 according to the teachings of the present invention allows the use of both heated and unheated hoses so that the operator can select the type of hose 74 desired to take advantage of the benefits and avoid the shortcomings of the particular type of hose according to the actual temperature and working conditions encountered.

Although the asphalt applicator 10 of the most preferred form includes several unique features which are believed to produce synergistic results, such features could be used separately or in other combinations. For example, the chimney tube 42, or similar venting means, could be used with various other styles and types of applicators, thus reducing problems occurring due to noxious fumes independent of the hose heating system employed. Likewise, the wand access port 100 could also be advantageously used on various styles and types of applicators. The particular arrangement utilized to heat the various hoses employed within the present invention, that is the particular arrangement which facilitates the full and practical use of heated and unheated hoses on the same applicator, is separate from and not dependent upon its combination with the various other improvements shown and described in the preferred embodiments.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. An applicator for melting and applying a paving material comprising, in combination:

a bin forming a chamber for receiving and supporting paving material;

a heating chamber with a heat generating device that is able to generate sufficient heat to melt the paving material received by and supported within the bin, the heat generating device is positioned to generate heat within the heating chamber, the heating chamber located proximate to the bin which receives and supports the paving material, so that heat generated by the heat generating device positioned within the heating chamber is transferred to the bin so that the paving material received by and supported within the bin is heated and melted;

a cabinet with an interior being selectively thermally connected to the heating chamber, wherein the cabinet is located proximate to at least a portion of the heating chamber so that a portion of the heat generated within the heating chamber by the heat generating device can be selectively directed from the heating chamber into the interior of the cabinet;

a recirculating pump for removing melted paving material from the bin after heat generated by the heating device within the heating chamber has melted the paving material within the bin, the recirculating pump having an input fluidly coupled to the bin so that the melted paving material within the bin may pass from the bin through the input and into the recirculating pump, the recirculating pump having a first output which is coupled to the bin so that at least a portion of the melted paving material that is drawn from the bin and through the input, is passed through the recirculating pump and returned through the first output and back into the bin so that the pumping of the melted paving material heats the pump and the heating of the pump by the flow of the melted paving material in combination with the flow of the melted paving material serves to prevent the melted paving material from solidifying within the pump and occluding the subsequent flow of the melted paving material, the recirculating pump having a second output wherein a quantity of the melted paving material is selectively allowed to flow from the bin, through the input into the recirculating pump and out through the second output, the recirculating pump being located within the interior of the cabinet so that when heat from the heating chamber is selectively allowed to pass from the heating chamber into the interior of the cabinet the recirculating pump is also heated so that any paving material located within the recirculating pump that has solidified is heated and melted; and a hose for controllably delivering the melted paving material that has been heated in the bin, the hose having a first end being coupleable to the second output of the recirculating pump for receipt of melted paving material selectively allowed to pass from the bin, the hose being either of a heated or an unheated type wherein the recirculating pump is interchangeably coupleable to both the heated and the unheated type hose, so that the hose can be received in the cabinet and heat selectively directed into the interior of the cabinet from the heating chamber is sufficient to melt any paving material which remains in the hose and the heated type hose is selectively coupleable to a heating unit which operates a heating element that surrounds the hose, wherein the heating unit causes the heating element to heat the hose to a temperature sufficient to liquefy paving material at least when the hose is outside of the cabinet.

2. The applicator of claim 1, further comprising, in combination:

a wand access port in fluid communication with the bin that receives and supports the paving material, the wand access port dimensioned to accommodate a wand that is coupled to a second end of the hose so that the wand may be inserted into and supported by the wand access port, wherein the proximity of the wand access port to the bin allows heat from the bin to heat the wand of the hose when the wand is inserted into and supported by the wand access port and also allows the melted paving material to selectively flow through the hose and out of the wand, wherein the heated paving material flowing out of the wand is returned to the bin through the wand access port.

3. The applicator of claim 1, further comprising, in combination:

a chimney that is in fluid communication with the heating chamber, for removing fumes and gases from the heating chamber that are produced by the heat generating device as it generates heat within the heating chamber, the chimney also being in fluid communication with the bin that receives and supports the paving material, so that fumes and gases produced within the bin, as the heat generated by the heat generating device heats the heating chamber which heats the bin and subsequently melts the paving materials, are removed from the bin through the chimney.

4. The applicator of claim 3 wherein the interior of the cabinet is selectively thermally connected to the heating chamber by a vent connected between the heating chamber and the interior of the cabinet for selectively allowing heat to flow from the heating chamber into the interior of the cabinet.

5. The applicator of claim 1 wherein the heated type hose further includes:

a sheath surrounding the hose so that the sheath surrounds an entirety of the hose except for a valve and a nozzle which are coupled to the second end of the hose, wherein the sheath includes a heating element woven into and extending along substantially an entire length of the sheath.

6. The applicator of claim 1, further comprising, in combination:

a removable extension having a first end and a second end, the first end of the removable extension coupleable to the second output of the recirculating pump and the second end coupleable to the first end of the hose, the extension having a length such that the coupling between the hose and the extension occurs proximate an outer wall of the cabinet.

7. An applicator for melting and applying a paving material, comprising, in combination:

a bin forming a chamber for receiving and supporting paving material;

a heating chamber with a heat generating device that is able to generate sufficient heat to melt the paving material received by and supported within the bin, the heat generating device is positioned to generate heat within the heating chamber, the heating chamber located proximate to the bin which receives and supports the paving material, so that heat generated by the heat generating device positioned within the heating chamber is transferred to the bin so that the paving material received by and supported within the bin is heated and melted, with the heating chamber being in fluid communication with the bin that receives and supports the paving material, so that fumes and gases produced within the bin as the heat generated by the heat generating device heats the heating chamber which heats the bin and subsequently melts the paving materials, are removed from the bin;

a pump for selectively removing melted paving material from the bin, the pump having an input fluidly coupled with the bin and a first output, so that the melted paving material that is selectively removed from the bin passes into the pump through the input and is expelled from the pump through the first output; and a hose for controllably delivering the melted paving material that has been heated in the bin, the hose having a first end that is coupleable to the first output of the pump so that the melted paving material that is selectively expelled from the pump is passed through the hose.

8. The applicator of claim 7 wherein the heating chamber is in fluid communication with the bin which receives and supports the paving material by being coupled to the bin via a chimney tube so that the chimney tube provides the fluid communication between the heating chamber and the bin, the chimney tube being positioned so that an end of the chimney tube which is coupled to the bin is located at a point higher in the bin than the melted paving material is allowed to reach.

9. The applicator of claim 7 wherein the pump is a recirculating pump, for removing melted paving material from the bin after heat generated by the heating device within the heating chamber has melted the paving material within the bin, the recirculating pump having a second output which is coupled to the bin so that at least a portion of the melted paving material that is drawn from the bin and through the input, is passed through the recirculating pump and returned through the second output and back into the bin so that the pumping of the melted paving material heats the pump and the heating of the pump by the flow of the melted paving material in combination with the flow of the melted paving material serves to prevent the melted paving material from solidifying within the pump and occluding the subsequent flow of the melted paving material.

10. The applicator of claim 7 wherein the hose is a heated hose for controllably delivering the melted paving material that has been heated in the bin, wherein the heated hose can be brought to a temperature sufficient to maintain the melted paving material in a melted state.

11. The applicator of claim 10 wherein the heated hose further includes:

a sheath surrounding the hose so that the sheath surrounds an entirety of the hose except for a valve and a nozzle which are coupled to the second end of the hose, wherein the sheath includes a heating element woven into and extending along substantially an entire length of the sheath.

12. The applicator of claim 10 further comprising, in combination:

an extension coupleable between the first output of the pump and the heated hose so that a coupling between the hose and the extension occurs proximate an outer wall of the cabinet.

13. The applicator of claim 7 further comprising, in combination:

a cabinet with an interior for receiving the hose in a coiled condition, the cabinet interior being selectively thermally connected to the heating chamber, wherein the cabinet is located proximate to at least a portion of the heating chamber so that a portion of the heat generated within the heating chamber by the heat generating device can be selectively directed from the heating chamber into the interior of the cabinet, wherein the heat directed into the interior of the cabinet from the heating chamber is sufficient to melt any paving material which remains in the coiled hose when the coiled hose is received within the interior of the cabinet and heat from the heating chamber is selectively directed into the interior of the cabinet.

14. The applicator of claim 13 wherein the pump is located within the interior of the cabinet so that when heat from the heating chamber is selectively allowed to pass from the heating chamber into the interior of the cabinet, the pump is also heated so that any paving material located within the pump that has solidified is heated and melted.

15. The applicator of claim 13 wherein the interior of the cabinet is selectively thermally connected to the heating chamber by a vent connected between the heating chamber and the interior of the cabinet for selectively allowing heat to flow from the heating chamber into the interior of the cabinet.

16. The applicator of claim 7, further comprising, in combination:

a wand access port in fluid communication with the bin that receives and supports the paving material, the wand access port dimensioned to accommodate a wand that is coupled to a second end of the hose so that the wand may be inserted into and supported by the wand access port, wherein the proximity of the wand access port to the bin allows heat from the bin to heat the wand of the hose when the wand is inserted into and supported by the wand access port and also allows the melted paving material to selectively flow through the hose and out of the wand, wherein the heated paving material flowing out of the wand is returned to the bin through the wand access port.

17. An applicator for melting and applying a paving material comprising, in combination:

a bin forming a chamber for receiving and supporting paving material;

a heating chamber with a heat generating device that is able to generate sufficient heat to melt the paving material received by and supported within the bin, the heat generating device is positioned to generate heat within the heating chamber, the heating chamber located proximate to the bin which receives and supports the paving material, so that heat generated by the heat generating device positioned within the heating chamber is transferred to the bin so that the paving material received by and supported within the bin is heated and melted, with the heating chamber being in fluid communication with the bin that receives and supports the paving material, so that fumes and gases produced within the bin as the heat generated by the heat generating device heats the heating chamber which heats the bin and subsequently melts the paving materials, are removed from the bin;

a cabinet with an interior being selectively thermally connected to the heating chamber, wherein the cabinet is located proximate to at least a portion of the heating chamber so that a portion of the heat generated within the heating chamber by the heat generating device can be selectively directed from the heating chamber into the interior of the cabinet;

a recirculating pump for removing melted paving material from the bin after heat generated by the heating device within the heating chamber has melted the paving material within the bin, the recirculating pump having an input fluidly coupled to the bin so that the melted paving material within the bin may pass from the bin through the input and into the recirculating pump, the recirculating pump having a first output which is coupled to the bin so that at least a portion of the melted paving material that is drawn from the bin and through the input, is passed through the recirculating pump and returned through the first output and back into the bin so that the pumping of the melted paving material heats the pump and the heating of the pump by the flow of the melted paving material in combination with the flow of the melted paving material serves to prevent the melted paving material from solidifying within the pump and occluding the subsequent flow of the melted paving material, the recirculating pump having a second output wherein a quantity of the melted paving material is selectively allowed to flow from the bin, through the input into the recirculating pump and out through the second output, the recirculating pump being located within the interior of the cabinet so that when heat from the heating chamber is selectively allowed to pass from the heating chamber into the interior of the cabinet the recirculating pump is also heated so that any paving material located within the recirculating pump that that has solidified is heated and melted; and a hose for controllably delivering the melted paving material that has been heated in the bin, the hose having a first end being coupleable to the second output of the recirculating pump for receipt of melted paving material selectively allowed to pass from the bin, the hose being either of a heated or an unheated type wherein the recirculating pump is interchangeably coupleable to both the heated and the unheated type hose, so that the hose can be received in the cabinet and heat selectively directed into the interior of the cabinet from the heating chamber is sufficient to melt any paving material which remains in the hose and the heated type hose is selectively coupleable to a heating unit which operates a heating element that surrounds the hose, wherein the heating unit causes the heating element to heat the hose to a temperature sufficient to liquefy paving material at least when the hose is outside of the cabinet.

18. The applicator of claim 17, further comprising, in combination:

a wand access port in fluid communication with the bin that receives and supports the paving material, the wand access port dimensioned to accommodate a wand that is coupled to a second end of the hose so that the wand may be inserted into and supported by the wand access port, wherein the proximity of the wand access port to the bin allows heat from the bin to heat the wand of the hose when the wand is inserted into and supported by the wand access port and also allows the melted paving material to selectively flow through the hose and out of the wand, wherein the heated paving material flowing out of the wand is returned to the bin through the wand access port.

19. The applicator of claim 17 wherein the interior of the cabinet is selectively thermally connected to the heating chamber by a vent connected between the heating chamber and the interior of the cabinet for selectively allowing heat to flow from the heating chamber into the interior of the cabinet.

20. The applicator of claim 17 wherein the heated type hose further includes:

a sheath surrounding the hose so that the sheath surrounds an entirety of the hose except for a valve and a nozzle which are coupled to the second end of the hose, wherein the sheath includes a heating element woven into and extending along substantially an entire length of the sheath.

* * * * *